United States Patent [19]

Hara

[11] 4,198,617

[45] Apr. 15, 1980

[54] THERMAL CUT-OFF FUSE

[75] Inventor: Kunio Hara, Kawasaki, Japan

[73] Assignee: Nifco Incorporated, Tokyo, Japan

[21] Appl. No.: 939,971

[22] Filed: Sep. 6, 1978

[30] Foreign Application Priority Data

Sep. 12, 1977 [JP] Japan ..... 52/108917

[51] Int. Cl.[2] ..... H01H 37/76

[52] U.S. Cl. ..... 337/403; 337/405

[58] Field of Search ..... 337/403, 404, 405, 407, 337/408, 409

[56] References Cited

U.S. PATENT DOCUMENTS

| | | | |
|---|---|---|---|
| 1,031,847 | 7/1912 | Harley | 337/405 |
| 2,464,340 | 3/1949 | Newbill | 337/405 |
| 3,386,063 | 5/1968 | Mansfield | 337/405 |

*Primary Examiner*—George Harris

*Attorney, Agent, or Firm*—Oblon, Fisher, Spivak, McClelland & Maier

[57] ABSTRACT

A thermal cut-off fuse of the class wherein the electric continuity between electrodes disposed inside a housing is maintained by conductor means at normal service temperatures and broken by the conductor means being fractured when the ambient temperature reaches a fixed level is improved by having the conductor means made of a metal capable of liquefying before the ambient temperature reaches the fixed level mentioned above and providing a thermal pellet faithfully fusible at the fixed level of temperature for the purpose of supporting in position the conductor means serving to maintain the electric continuity between the electrodes at normal service temperatures and thereby allowing the electric continuity between the electrodes to be broken at the fixed level of temperature by the thermal pellet being melted and deprived of its role of supporting the conductor means.

8 Claims, 12 Drawing Figures

THERMAL CUT-OFF FUSE

BACKGROUND OF THE INVENTION

This invention relates to a thermal cut-off fuse which uses no mechanically operable part, enjoys simplicity of construction and high accuracy of operation, and serves in an electric appliance incorporating a heat source the purpose of breaking the electric circuit of the electric appliance when the ambient temperature of the electric appliance is caused, for some reason or other, to rise from the rated range of service temperatures and reach a dangerous temperature zone and consequently stopping the phenomenon of heat generation.

A thermal cut-off fuse of one type is designed so that a thermal pellet capable of assuming a solid state at normal temperatures below a fixed level and a liquid state at or above the fixed level of temperature is disposed inside the housing of the fuse and, upon elevation of the ambient to the fixed level, the thermal pellet is transformed from the solid state to the liquid state is consequently diminished in volume and this voluminal change of the pellet is converted into a mechanical movement of relevant internal elements of the fuse to open the contact mechanically and break the electric continuity between the electrodes.

Various thermal cut-off fuses have heretofore been developed on the basis of this operating principle. They are invariably provided with contact means braced up in position by some proper resilient means and auxiliary means adapted to actuate freely this contact means as desired. Thus, they inevitably have a complicated construction and entail a heavy burden in terms of design, fabrication and cost. Furthermore, since they use means for producing mechanical movements, they tend to develop mechanical troubles and consequently pose problems of inferior reliability.

On the other hand, there has been developed a thermal cut-off fuse which uses no mechanically operable parts and serves a mere purpose of breaking the electric circuit in which the fuse is contained when the ambient temperature rises excessively. A typical thermal cut-off fuse of this type is characterized by using a fusible alloy as the material for the active element adapted to break the electric circuit at the fixed level of temperature. Such a fusible alloy is not melted completely at one point of temperature but melts over a fairly wide range of temperatures. When the alloy is kept at an elevated temperature near its melting point for a long time, the melting point is greatly varied. In the use of such a conventional thermal fuse, therefore, it has been found necessary to select and use a fusible alloy whose melting point is considerably lower than the upper limit of allowable service temperatures rated for the electric appliance. Incorporation of such a fusible alloy in effect lowers the efficiency of the electric appliance with a heat source to an extent more than is actually necessary.

An object of this invention is to provide a thermal cut-off fuse which has no mechanically operable element and enjoys simplicity of construction and which, upon insertion in the electric circuit of an electric appliance provided with a heat source, enables the electric continuity of the circuit to be broken precisely at the time that the ambient temperature reaches the fixed level.

SUMMARY OF THE INVENTION

To accomplish the object described above according to this invention, there is provided a thermal cut-off fuse which comprises a housing having a pair of electrodes disposed therein; a thermal pellet possessing a melting point equalling the level of temperature fixed for the fuse and enclosed with the housing mentioned above; and conductor means retaining a liquid state at least at temperatures up to but not exceeding the fixed level and supported in position by the thermal pellet in such a manner as to maintain the electric continuity between the electrodes until the ambient temperature reaches the fixed level mentioned above, whereby the electric continuity maintained between the electrodes by the conductor means is broken by the thermal pellet being melted when the ambient temperature reaches the fixed level.

For example, mercury which is liquid at room temperatures is used as the conductor means and is retained in a space intervening between the electrodes by a thermal pellet which is solid at temperatures up to but not exceeding the fixed level (hereinafter referred to simply as "normal service temperatures"). The electric continuity between the electrodes, therefore, depends substantially upon the thermal pellet. The fact that the ambient temperature rises to reach the fixed level causes the thermal pellet to melt sensitively and cease supporting the conductor means in position, with the result that the electric continuity between the electrodes is broken. The thermal pellet responses with the utmost accuracy to temperature and, accordingly, constitutes itself the optimum active element for the thermal fuse and confers accurate thermal responsivity and simple construction upon the thermal fuse.

The other objects and characteristic features of the present invention will become apparent from the description to be given in detail herein below with reference to the accompanying drawing.

DESCRIPTION OF THE PREFERRED EMBODIMENT

Figure 1A:
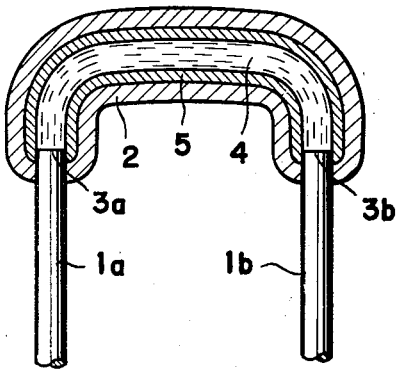
Fig-1(A) PRIOR ART
FIG. 1(A) and FIG. 1(B) are partially sectioned views of a conventional thermal cut-off fuse, respectively in a normal service condition at temperatures below the fixed level and in a condition in which the electric continuity between the electrodes is broken at temperatures in the neighborhood of the fixed level.

A typical construction of a conventional thermal cut-off fuse which has no mechanically operable elements. The thermal cut-off fuse is provided with lead wires 1*a*, 1*b* connected to an electric circuit. The terminals of the lead wires enter a tightly closed housing 2 to form a pair of electrodes 3*a*, 3*b*. These two electrodes are connected with each other by the medium of a fusible alloy 4 which melts when the ambient temperature is in the neighborhood of the fixed level and retains its solid state when the ambient temperature is below the fixed level. FIG. 1(A) illustrates the thermal cut-off fuse in its normal service condition. In this case, a coating 5 such as of paraffin which melts at temperatures lower than the melting point of the fusible alloy is disposed to cover the periphery of the fusible alloy 4, with the housing 2 formed to cover completely the entire surface of the coating 5. In actual use, the housing 2 may be formed in a multi-layer construction, depending on the temperature conditions under which the thermal fuse is used.

Figure 1B:
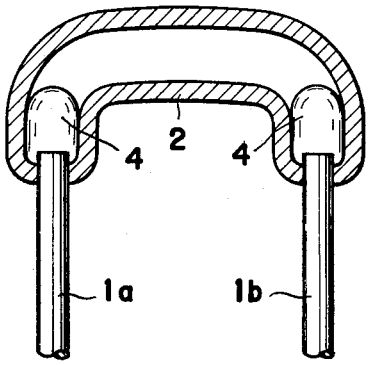
Fig-1(B) PRIOR ART

Now the process in which the ambient temperature of the thermal cut-off fuse rises to reach the fixed level (i.e. the melting point of the fusible alloy used therein) will be considered. Before the ambient temperature reaches the fixed level, the coating 5 which has a lower melting point than the fusible alloy melts. Consequently, the space which the coating 5 occupied inside the housing 2 when the coating was in a solid state becomes void. At this point, the fusible alloy 4 still retains its solid state and, therefore, remains in a form poised amid the vacant space. Thus, the two electrodes have their electric continuity still retained unimpaired. This condition may well be regarded normal as yet. As the ambient temperature eventually reaches the fixed level, the fusible alloy 4 which under the aforementioned normal condition served as conductor means inside the fuse proper melts and the molten alloy, inside the void space formed in consequence of the melting of the coating 5, is separated into two spherical liquid masses near the electrodes 3*a*, 3*b* extended to the lead wires by virtue of the surface tension as illustrated in FIG. 1(B). To ensure this separation, the fusible alloy 4 and the housing 2 are each formed in the shape of an inverted U so that the molten alloy will be caused by their weight to settle at the two stablest and most separated positions, namely in the immediate vicinities of the electrodes which happen to be the lowest positions found inside the void space.

Generally, the fusible alloy has its melting point dispersed over a considerably wide range and this melting point may be greatly changed when the alloy is exposed to high temperatures close to the melting point for a long time. In the design and manufacture of thermal fuses, the fixed temperature is selected for a particular model. Then, the producer of alloy is requested to formulate an alloy which possesses a melting point equalling the fixed temperature selected in the course of the design as described above. The alloys actually received from the alloy producer at the time the manufacture of thermal fuses is to be started often include those having melting points deviating from the specified fixed temperature and those which are found during the manufacture of thermal fuses to possess melting points conforming to the specified fixed temperature but which have their melting points deviate from the fixed temperature when they are incorporated in electric appliances and subsequently are left by chance to stand at high temperatures, though not reaching the melting points, for a long time. Thus, with such fusible alloys, it is not necessarily impossible that they will fail to fulfill the role of breaking the electric circuits of electric appliances even when, for some cause or other, the ambient temperatures rise to exceed the rated dangerous temperatures of the appliances. This failure can result not only in damage to the electric appliances themselves but also in fires and other disasters. In the conventional thermal cut-off fuse illustrated in FIG. 1(A) and FIG. 1(B), the electric continuity of the fuse proper, generally through the two electrodes 3*a*, 3*b*, is broken by the melting of the conductor means 4 of fusible alloy which serves to establish connection between the electrodes and also functions as a direct active element. Thus, the conventional thermal cut-off fuse cannot be freed from the disadvantage described above. Despite this serious disadvantage, there has been introduced no new idea which completely departs from the underlying design of the conventional thermal cut-off fuse possibly through appreciation of simplicity of construction and safety of operation.

With a view to eliminating the disadvantage suffered by the conventional thermal cut-off fuse, the present invention uses as the direct active element the thermal pellet which, for its excellent temperature responsivity, has been used in another type of conventional thermal fuse. This does not mean that the thermal fuse of this invention has as complicated a construction as the conventional thermal fuse of the type using the thermal pellet or that it has as inferior temperature responsivity and low reliability as the conventional thermal fuse of the type using an active element of fusible alloy.

The thermal cut-off fuse of the present invention will be described with reference to the diagrams of FIG. 2. A housing 12 which has a pair of lead wires 11*a*, 11*b* extending outwardly and has the inner terminals of the lead wires forming a pair of electrodes 13*a*, 13*b* within an inner space a enclosed with the housing constitutes one of the component elements of the thermal fuse.

This housing 12 is desired to be made of a material which undergoes neither deformation nor fusion under the heat conditions under which the thermal fuse is put to service. Insofar as this requirement is satisfied, the housing may be made of a suitable synthetic resin or some other suitable material.

Inside the inner space a of this housing 12, a thermal pellet 15 which melts at the fixed temperature selected at the time of designing is contained in such a manner as to define therein a space b.

Numerous kinds of thermal pellets made of varying materials depending on varying magnitudes of fixed temperatures have been developed and marketed. As is widely known, each thermal pellet has quite faithful temperature responsivity with respect to the fixed temperature designed for itself. Unlike the fusible alloys thermal pellets manufactured for one specified fixed temperature have no dispersion of melting point relative to the fixed level and faithfully melt at a temperature not different by as much as several degrees from the fixed level. When the thermal pellet is converted from the solid state to the liquid state, it acquires fluidity and assumes a volume smaller than when it is in the solid state.

The space b formed inside the thermal cut-off pellet is filled with conductor means 14 serving to retain the electric continuity between the electrodes 13*a*, 13*b*. While the conventional thermal cut-off fuse of this type uses conductor means made of a fusible metal which melts at the fixed level of temperature, the conductive means in the thermal fuse of this invention is desired to be made of a conductive metal such as, for example, mercury which assumes a liquid state at least at temperatures lower than the fixed level.

In the thermal cut-off fuse of the construction described above, the electric continuity between the two electrodes 13*a*, 13*b* is retained under the normal service conditions.

When this thermal cut-off fuse is incorporated in an electric appliance provided with a heat source and, for some cause or other, the ambient temperataure of this thermal fuse rises to reach the fixed level, the thermal fuse precisely functions to break the electric continuity so as to stop the flow of electric current to the electric appliance incorporating this thermal fuse. As illustrated in FIG. 2(B), when the ambient temperature reaches the fixed level, the thermal pellet 15 which has faithful temperature responsivity as described above melts into a liquid and loses its volume and, because of its weight, flows within the space a inside the housing 12 and eventually collects in the lowest positions. By this time, the conductor means 14 which formerly kept the two electrodes 13*a*, 13*b* in direct connection to each other has assumed the liquid state. The liquefied conductor means is no longer able to remain in its former position because the solid thermal pellet has already ceased defining the space b formed for the retention of the conductor means. By the same token, the molten conductor means flows downwardly inside the space a under its weight and eventually separates into two spherical liqiud masses embracing the two electrodes 13*a*, 13*b*. Consequently, the purpose of the thermal cut-off fuse is accomplished by breaking the electric continuity between the two electrodes 13*a*, 13*b* and consequently between the two lead wires 11*a*, 11*b*. To ensure this separation of the molten conductor means, a protuberance 16 may be formed inside the space a as by constricting the housing in the middle as illustrated. The ridge of this protuberance 16 serves the purpose of precisely dividing laterally the molten conductor means 14 which has flowed down inside the space toward the protuberance.

Figure 2A:
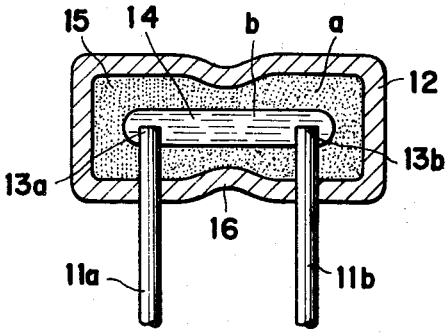
FIG. 2(A) and FIG. 2(B) are partially sectioned views of a first preferred embodiment of the thermal cut-off fuse according to the present invention, respectively in a normal service condition at temperatures below the fixed level and in a condition in which the electric continuity between the electrodes is broken at the time that the ambient temperature reaches the fixed level.
Figure 2B:
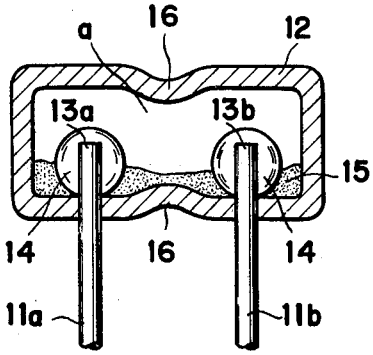
Figure 3:
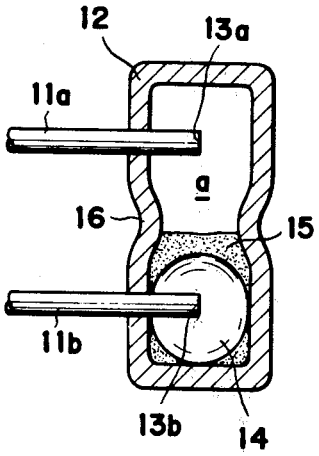
FIG. 3 represents the thermal cut-off fuse of FIG. 2 used in a posture different from the posture of FIG. 2, to illustrate a condition in which the electric continuity between the electrodes is broken.

When the thermal cut-off fuse is used not in its horizontal position as illustrated in FIG. 2(B) but in its vertical position as illustrated in FIG. 3, since the two electrodes 13*a*, 13*b* assume a vertical relationship to each other, the thermal pellet 15 which melts to break the electric continuity and the liquefied conductor means 14 flow down and collect in the lowest position under its weight. Consequently, the electric continuity between the two electrodes 13*a*, 13*b* is safely broken without necessitating the protuberance 16.

The present preferred embodiment is presumed generally to use mercury as the conductor means 14 which serves the purose of selectively maintaining or breaking the electric continuity between the two electrodes 13*a*, 13*b*.

Mercury has very little affinity for other substances. When the thermal pellet melts, therefore, the mercury is caused under the influence of surface tension to collect and adhere to the electrodes made of a metal for which mercury has relatively high affinity.

So far, use of mercury as the conductor means has been described. If mercury proves improper for reason of cost, some other less expensive material may be used. In other words, the conductor means can be made of solder or some other suitable fusible alloy which has a solid state under normal service condition and assumes a liquid state at temperatures somewhat lower than the fixed level of temperature (melting point) of the particular thermal pellet selected for use in the thermal fuse.

Another preferred embodiment which uses such a fusible alloy will be described with reference to FIGS. 4(A) through 4(C). The construction of the thermal cut-off fuse of this preferred embodiment is not basically different from that of the preceding preferred embodiment except that a fusible alloy which assumes a solid state at the normal service temperature is used in the place of the liquid conductor means 14 which has occupied the inner space b defined by the thermal pellet at the normal service temperature or in a static condition. Thus, like component parts of the present thermal cut-off fuse and the preceding thermal fuse are denoted by like symbols.

Figure 4A:
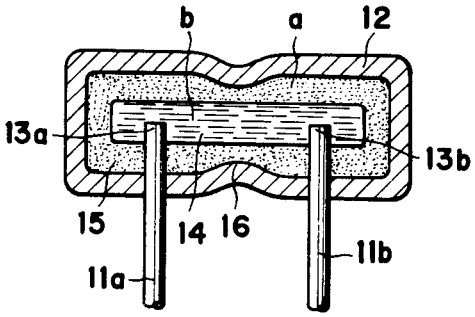
FIGS. 4(A) through 4(C) are partially sectioned views of a second preferred embodiment of the thermal cut-off fuse according to this invention, respectively in a normal service condition at temperatures below the fixed level, in a condition in which the electric continuity between the electrodes is on the verge of being broken when the ambient temperature reaches the neighborhood of the fixed level and in a condition in which the electric continuity is completely broken at the time that the ambient temperature reaches the fixed level.

At the normal service temperature, the thermal cut-off fuse as illustrated in FIG. 4(A) assumes a state not different in any way from the state of the thermal fuse of the preceding preferred embodiment illustrated in FIG. 2(A). The electric continuity between the two electrodes 13*a*, 13*b* and consequently the two lead wires 11*a*, 11*b* serving to connect the electrodes to an outer power supply is established by the conductor means 14 which, in the present case, is made of a solid fusible alloy.

In the process in which the ambient temperature rises to approach the fixed level, the fusible alloy first melts as the temperature reaches the melting point of the fusible alloy. The thermal fuse is so constructed that in the stage the conductor means 14 assumes a liquid state, the liquefied conductor means will still retain the electric continuity between the two electrodes as illustrated in FIG. 4(B).

Figure 4B:
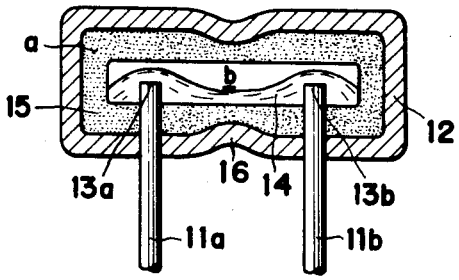
Figure 4C:
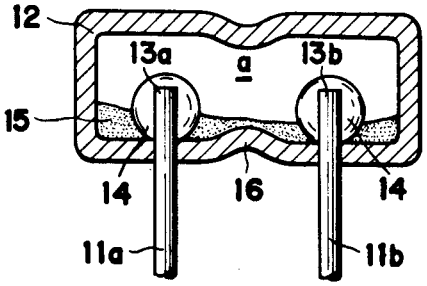

When the thermal cut-off fuse is exposed to temperatures higher than those involved in the condition of FIG. 4(B) and eventually brought to the fixed level, the thermal pellet 15 held in the space a inside the housing 12 melts and contracts and then flows down in the form of a liquid pellet as illustrated in FIG. 4(C) and, as the result, continues its descent in conjunction with the conductor means 14 of fusible alloy which has been converted into a liquid state and permitted to maintain the electric continuity between the two electrodes, with the result that the liquefied conductor means is separated into two spherical liquid masses to break the electric connection between the two electrodes. In this case, the protuberance 16 serves the purpose of ensuring the separation similarly to that used in the first preferred embodiment.

Figure 5A:
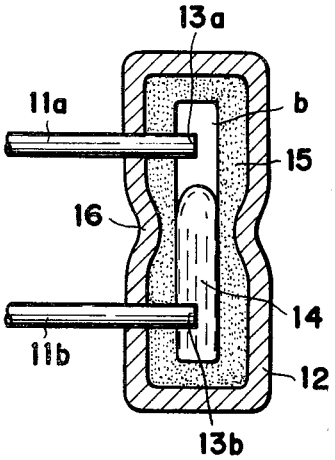
FIG. 5(A) illustrates a disadvantageous condition which tends to occur when the thermal cut-off fuse of FIG. 4 is used in a different posture.

Particularly where the operation of the thermal cut-off fuse involves a step of the fusible alloy being liquefied at temperatures below the fixed level, while the liquefied conductor means assumes a position for maintaining the electric continuity between the two electrodes in the thermal fuse used in a horizontal position as illustrated in FIG. 4(B), the liquefied conductor means 14 only collects in the lowest position relative to the direction of gravity and the height of the collected liquefied mass may possibly fail to reach the upper one of the two electrodes positioned in a vertical relationship to each other in the case of the thermal fuse used in a vertical position as illustrated in FIG. 5(A). Where there is a possibility of the thermal fuse being used in an erect position, the disadvantage illustrated in FIG. 5(A) may be eliminated by increasing the inner volume of the space b inside the thermal pellet at the end portions accommodating the electrodes 13*a*, 13*b* so that when the fusible alloy melts and contracts, the space corresponding to the decrease of the volume of the fusible alloy will be embraced by the increased inner volume at the end portions and, consequently, the electric continuity between the two electrodes will be maintained until the ambient temperature reaches the fixed level.

Figure 5B:
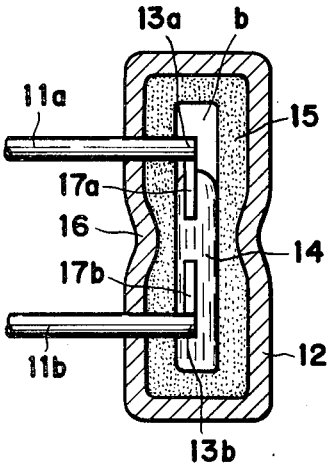
FIG. 5(B) illustrates a third preferred embodiment of the thermal fuse of this invention, with a modification introduced to eliminate the disadvantage shown in FIG. 5(A).

Alternatively, auxiliary electrode means 17*a*, 17*b* may be disposed one each at the leading ends of the electrodes 13*a*, 13*b* in mutually approaching relationship so that the electric continuity between the electrodes will be maintained as illustrated in FIG. 5(B) even when the conductor means 14 has its volume greatly decreased in consequence of its melting. By the incorporation of these auxiliary electrode means, the amount of fusible alloy used as the conductor means can also be decreased.

Since fusible alloy mostly have their melting points dispersed in wide ranges as previously touched upon, the second preferred embodiment necessitates acquisition of through knowledge on maximum dispersions of their melting points and subsequent adoption, based on that knowledge, of a particular fusible alloy which never fails to liquefy before the ambient temperature reaches the fixed level.

Figure 6:
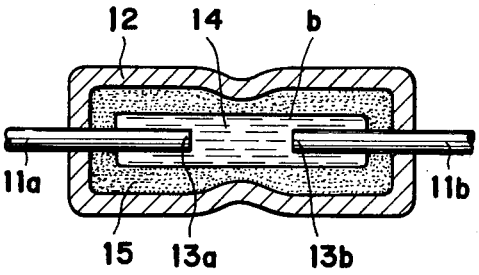
FIG. 6 represents a fourth preferred embodiment of the thermal cut-off fuse of the present invention.

The two preferred embodiments described above have been presumed to use two parallelly withdrawn lead wires as means for electrically connecting the electrodes to an outer power supply. As occasion demands, however, the thermal cut-off fuse of this invention can otherwise be constructed in a horizontal form having two lead wires 11*a*, 11*b* withdrawn in mutually opposite directions in a straight line as illustrated in FIG. 6.

The thermal cut-off fuses of the two preferred embodiments can freely be manufactured by a casting technique. Particularly in the case of the thermal fuse of the first preferred embodiment using a conductor means which is in a liquid state from the beginning, when there is adopted a technique which involves first collectively molding all the component parts of the thermal cut-off fuse except for the inner space b intended to accommodate the conductor means and subsequently filling that inner space b with the conductor means introduced from outside, the manufacture may advantageously be accomplished by causing a flow path for introducing the liquid conductor means into the inner space b to be perforated through the pellet 15 and the housing 12, filling the inner space b with the conductor means transferred through the perforated flow path and thereafter sealing the flow path with a cap or some other suitable synthetic resin coat.

Figure 7:
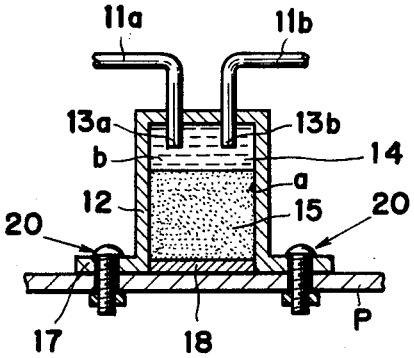
FIG. 7 represents a fifth preferred embodiment of the thermal cut-off fuse of this invention.

FIG. 7 illustrates yet another preferred embodiment of the thermal cut-off fuse of this invention, which is designed to be used in a predetermined position such as in a horizontal position, for example.

When the position in which the thermal cut-off fuse is to be placed for its actual service is predetermined as described above, the space reserved for permitting the downward flow and subsequent separation of the conductor means is required to occur in the lowest part of the housing interior relative to the vertical direction. In the present preferred embodiment, therefore, the space a enclosed with the housing 12 is filled with the thermal pellet 14 to a height such as to leave in the uppermost portion thereof an inner space b for accommodating the conductor means and this inner space b is filled with the conductor means 14. This preferred embodiment has the thermal pellet disposed in a position such that the space reserved for the downward flow of the conductor means will be allowed to occur only in the lowermost portion of the housing interior, whereas the foregoing preferred embodiments invariably have the conductor means at a position separated in all directions from the inner wall of the housing by the intervening thermal pellet.

Of course, the electrodes 13*a*, 13*b* are properly separated from each other inside the space b and are connected by lead wires 11*a*,11*b* to an outer power supply.

The housing 12 is provided with a flange 17 which permits the thermal cut-off fuse to be fastened to the base plate P with fastening means such as bolts and nuts.

In this preferred embodiment, the fracture of the thermal cut-off fuse is accomplished by the conductor means 14 being allowed to flow down into a space to be formed in the lowermost portion of the housing interior in consequence of the melting of the thermal pellet. This preferred embodiment is characterized by the fact that since the space for permitting the downward flow of the conductor means has only to be sought in the lowermost portion of the housing interior, the distance of the downward flow that can be expected from this thermal fuse is large for the size of the housing and the fact that since the conductor means does not cling to the electrodes after the fracture of the thermal fuse, the distance to separate the two electrodes 13*a*, 13*b* can be decreased and, consequently, the value of electric resistance for the thermal fuse can be decreased proportionately and, at the same time, the amount of the conductor means itself can be decreased, contributing to the simplification of the manufacture of the thermal fuse. To be specific, this thermal cut-off fuse can be manufactured by forcibly inserting the electrodes 13*a*, 13*b* into the housing having the space a preformed therein, then turning the housing upside down, placing the conductor means, placing the thermal pellet on top of the conductor means and covering the opening of the housing with a proper lid 18.

In the present preferred embodiment as well as in the preferred embodiments described previously, the housing 12 may be coated with an outer shell and this outer shell may be made of a metal so that one of the two electrodes will be electrically connected to an outer power supply through the medium of this outer shell. The means for electrically connecting the two electrodes 13*a*, 13*b* to the outer power supply need not be limited to lead wires. A plug or some other connector may be used as one of the means so as to facilitate insertion of the thermal fuse to the electric circuit.

Unlike the conventional countertype illustrated in FIG. 1(A) and FIG. 1(B) which accomplishes the breakage of the electric continuity of the fuse by solely relying upon the melting of the fusible alloy susceptible of a heavy error in temperature responsivity, the thermal cut-off fuse of the present invention accomplishes the breakage by the melting of the thermal pellet possessing faithful temperature responsivity and, therefore, enjoys high accuracy of operation, simplicity of construction and excellence of effect as described in detail above.

We claim:

1. A thermal cut-off fuse, comprising in combination:
   - a housing having a pair of lead wires withdrawn outwardly therefrom and having the terminals of the lead wires forming a pair of opposed electrodes;
   - a thermal pellet made of a substance capable of assuming a solid state at normal service temperatures and faithfully melting in response to the rise of the ambient temperature to a fixed level and placed inside said housing; and
   - a conductor means made of a substance capable of assuming a liquid state at least before the ambient temperature reaches the fixed level and adapted to be retained by said thermal pellet in a position for maintaining the electric continuity between the pair of electrodes until the ambient temperature reaches the fixed level.

2. The thermal cut-off fuse according to claim 1, wherein protuberances are formed inwardly in the housing interior by having the housing constricted in the middle, the protuberances serving to facilitate the separation of the conductor means melted at the fixed level of temperature.

3. The thermal cut-off fuse according to claim 1, wherein mercury is used as the conductor means.

4. The thermal cut-off fuse acccording to claim 1, wherein a fusible alloy capable of assuming a liquid state before the ambient temperature reaches the fixed level is used as the conductor means.

5. The thermal cut-off fuse according to claim 1, wherein the two electrodes are provided one each with auxiliary electrode means disposed in mutually approaching directions.

6. The thermal cut-off fuse according to claim 1, wherein the lead wires are withdrawn parallelly to each other out of the housing.

7. The thermal cut-off fuse according to claim 1, wherein the lead wires are withdrawn in mutually opposite direction in one straight line.

8. The thermal cut-off fuse according to claim 1, wherein the housing is provided with a flange adapted to have the thermal cut-off fuse attached to the base plate by fastening means.

* * * * *